United States Patent [19]

Kotera

[11] Patent Number: 4,613,289

[45] Date of Patent: Sep. 23, 1986

[54] CORROSION RESISTANT PUMP

[75] Inventor: Masayuki Kotera, Osaka, Japan

[73] Assignee: Seikow Chemical Engineering & Machinery, Ltd., Japan

[21] Appl. No.: 743,572

[22] Filed: Jun. 11, 1985

[30] Foreign Application Priority Data

Mar. 4, 1985 [JP] Japan ..... 60-42509

[51] Int. Cl.[4] ..... F04B 17/00

[52] U.S. Cl. ..... 417/420

[58] Field of Search ..... 417/420, 365

[56] References Cited

U.S. PATENT DOCUMENTS 2,864,552 12/1958 Anderson ..... 417/365 X 4,013,384 3/1977 Oikawa ..... 417/320 X 4,080,112 3/1978 Zimmermann ..... 417/365 X 4,226,574 10/1980 Villette ..... 417/420

4,414,523 11/1983 Pieters ..... 417/420 X

*Primary Examiner*—Richard E. Gluck

*Attorney, Agent, or Firm*—Larson & Taylor

[57] ABSTRACT

The corrosion resistant pump of this invention comprises a drive magnet rotatable by a motor, a driven magnet rotatable by the rotation of the drive magnet, a yoke having the driven magnet attached to its outer peripheral surface and a pump rotary shaft connected by shaft fixing means and shaft drive connecting means to the assembly of the driven magnet and the yoke and rotatable by the assembly when the drive magnet is rotated by the motor. A covering layer of corrosion resistant synthetic resin is formed over the driven magnet-yoke assembly.

3 Claims, 7 Drawing Figures

CORROSION RESISTANT PUMP

The present invention relates to a corrosion resistant pump, and more particularly to a corrosion resistant pump which comprises a drive magnet rotatable by a motor, a driven magnet rotatable by the rotation of the drive magnet, a yoke having the driven magnet attached to its outer peripheral surface, a pump rotary shaft drivingly connected to the assembly of the driven magnet and the yoke and rotatable by the assembly when the drive magnet is rotated by the motor, and a covering layer of corrosion resistant synthetic resin formed over the driven magnet-yoke assembly.

Such corrosion resistant pumps are known in which the assembly of a driven magnet and a yoke covered with a corrosion resistant synthetic resin layer is drivingly connected to a pump rotary shaft by keying the assembly to the shaft or by fastening the assembly to the shaft with nuts screwed on bolts provided at required peripheral portions of the shaft.

The prior-art pump has problems because the driven magnet-yoke assembly is drivingly connected to the rotary shaft with a key or bolts and nuts as mentioned above. Stated more specifically, it is difficult to connect the parts together firmly and stably with use of the key, because when the pump is brought into operation or is about to stop, the key groove portion of the corrosion resistant resin covering layer of the assembly is susceptible to damage due to the shake of the key to impair the durability of the covering layer, i.e. the corrosion resistance of the assembly. Further when the nut is used, the assembly is not always easy to fasten to the rotary shaft.

Accordingly, the main object of the present invention is to overcome the above drawbacks of the prior art and to make it possible to fixedly connect the pump rotary shaft easily to the assembly of driven magnet and yoke covered with a corrosion resistant synthetic resin layer without the likelihood that the covering layer will wear early.

Other objects of the invention will become apparent from the following description.

The corrosion resistant pump of the present invention comprises a drive magnet rotatable by a motor, a driven magnet rotatable by the rotation of the magnet, an annular yoke having the driven magnet attached to its outer peripheral surface, a covering layer of corrosion resistant synthetic resin formed over the driven magnet-yoke assembly and defining a shaft bore in the center of the assembly, and a pump rotary shaft extending through the shaft bore of the covering layer and fittingly connected to the assembly. The rotary shaft having an impeller at its front end, and the shaft bore defined by the corrosion resistant covering layer of the driven magnet-yoke assembly and the rotary shaft are provided, where the shaft is fitted in the bore, with shaft drive connecting means. This connecting means comprises bored portion and a shaft portion fitting therein, the bored and shaft portions having a cross sectional form other than a circular form. A plurality of shaft fixing means are aligned with each other and with the shaft drive connecting means axially of the rotary shaft and each comprises a bored portion and a shaft portion tightly fitting in the bored portion. The shaft fixing means in the rear is diametrically larger than the shaft fixing means in the front, the diametrically larger shaft fixing means including stepped stopper means for holding the shaft portion thereof to the bored portion thereof against axial displacement.

According to the present invention, the shaft bore defined by the corrosion resistant covering layer of the driven magnet-yoke assembly and the rotary shaft are provided, where the shaft is fitted in the bore, with shaft drive connecting means comprising a bored portion and a shaft portion fitting therein, the bored and shaft portions having a cross sectional form other than a circular form, and a plurality of shaft fixing means aligned with each other and with the shaft drive connecting means axially of the rotary shaft and each comprising a bored portion and a shaft portion tightly fitting in the bored portion, the shaft fixing means in the rear being diametrically larger than the shaft fixing means in the front. The resin-covered magnet-yoke assembly can therefore be drivingly connected and tightly connected to the rotary shaft by pressing the rotary shaft from the rear side of the assembly into the shaft bore defined by the covering layer over the assembly until an abutting portion of the stopper means on the shaft comes into contact with a stopper portion thereof at the corresponding bored portion. Since the front and rear shaft fixing means, each comprising a bored portion and a shaft portion tightly fittable therein, are aligned axially of the assembly, the rotary shaft can be centered in the shaft bore automatically and effectively when the parts are to be connected together. Furthermore, the rotary shaft and the resin-covered magnet-yoke assembly are fittingly connected together by the plurality of means which are thus axially aligned, with compressive stress acting in the synthetic resin covering layer, the parts can be connected very tightly with high stability.

Thus according to the present invention, the rotary shaft can be firmly and stably connected to the magnet-yoke assembly as desired by forcing the shaft into the shaft bore of the assembly defined by the corrosion resistant covering layer from the specified side without necessitating the key or nut conventionally used. The shaft and the assembly can therefore be fixedly connected together easily and simply without entailing the likelihood early wear of the covering layer. Further because the shaft and the assembly can be connected together by simple means without using any key or nut, the assembly can be integrally covered with corrosion resistant synthetic resin by a simple procedure, whereas the covering layer formed retains high strength to fully withstand the vibration due to pump cavitation and other cause.

Furthermore, the shaft connecting fixing system of the present invention is not subject to the undesired results due to a thrust during the rotation of the impeller and to elimination of the thrust when the impeller is about to come to a stop.

During the rotation of the impeller, a thrust load toward the impeller acts on the rotary shaft, while the attraction between the drive magnet and the driven magnet exerts a rearward thrust load on the magnet-yoke assembly. During the rotation of the impeller, therefore, the rotary shaft and the magnet-yoke assembly become connected together more firmly with respect to the axial direction at the stopper means, i.e. the abutting portion of the shaft and the stopper portion of the bored portion in bearing contact therewith. When the impeller is about to stop, the attraction between the drive magnet and the driven magnet produces a rearward thrust load acting on the assembly, with the result that the pressing contact of the stopper portion with the shaft abutting portion effectively holds the assembly connected to the rotary shaft with respect to the rearward axial direction. Thus, the stopper means contributes to the connection between the shaft and the assembly during the operation of the pump and also when the impeller is about to stop.

Embodiments of the invention will be described below with reference to the accompanying drawings, in which.

Figure 1:
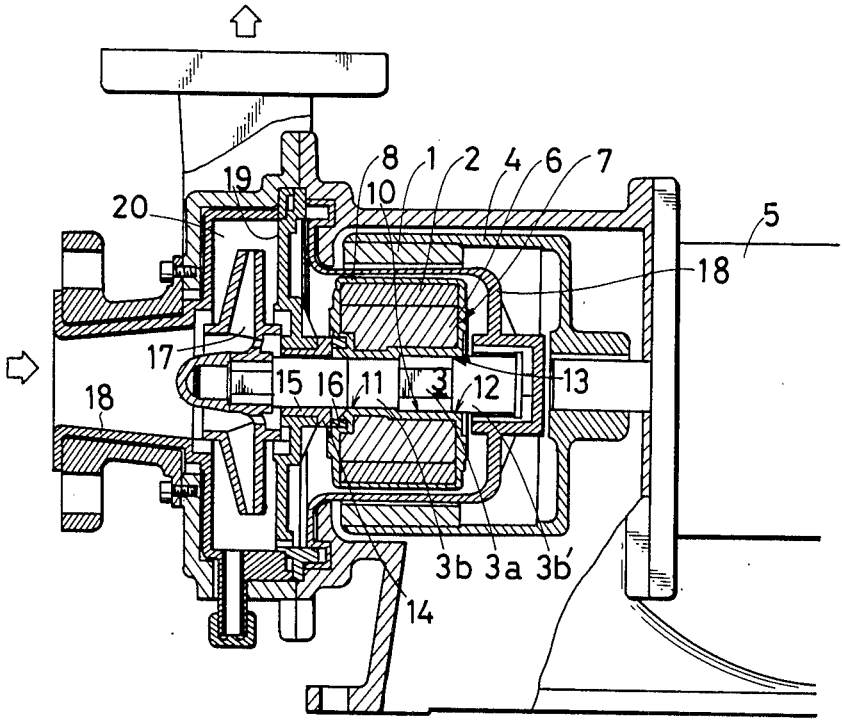
FIG. 1 is a side elevation in longitudinal section showing an embodiment of the invention.
Figure 2:
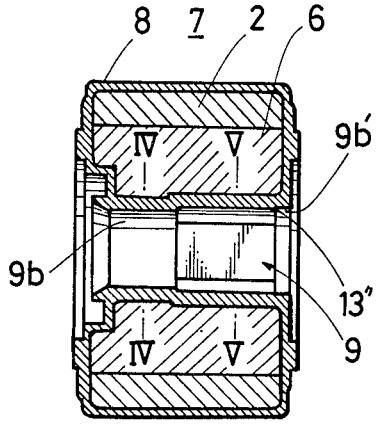
FIG. 2 is a view in longitudinal section of a driven magnet-yoke assembly covered with corrosion resistant synthetic resin layer and included in the embodiment.
Figure 3:
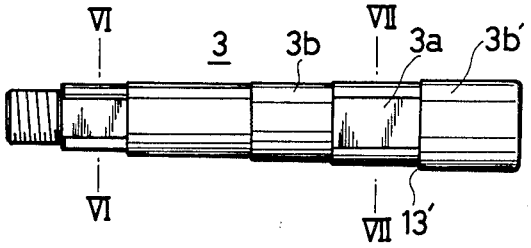
FIG. 3 is a side elevation showing a pump rotary shaft included in the embodiment.

The drawings show a drive magnet 1, a driven magnet 2 and a pump rotary shaft 3. The drive magnet 1 is attached to a holder 4 and is rotatable by a motor 5 through the holder 4. The driven magnet 2 is attached to the outer peripheral surface of an annular steel yoke 6. The assembly 7 of driven magnet 2 and yoke 6 is rotatable by the driven magnet 1. The driven magnet-yoke assembly 7 is covered with a layer 8 of a corrosion resistant synthetic resin, such as polyvinylidene difluoride, ethylene-tetrafluoroethylene copolymer, tetrafluoroethylene-hexafluoropropylene copolymer, perfluoroalkylvinyl ether-tetrafluoroethylene copolymer or like fluorocarbon resin. The rotary shaft 3 may be made of a rigid material such as alumina ceramics or silicon carbide.

The corrosion resistant covering layer 8 over the magnet-yoke assembly 7 defines a shaft bore 9, in which the rotary shaft 3 is fitted as described below to connect the shaft 3 to the assembly 7.

Figures 4, 5, 6, 7:
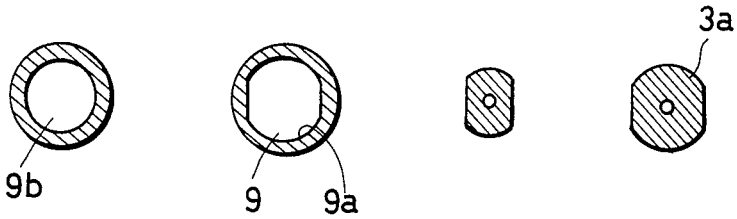
FIG. 4 is a view in section taken along the line IV—IV in FIG. 2.
FIG. 5 is a view in section taken along the line V—V in FIG. 2.
FIG. 6 is a view in section taken along the line VI—VI in FIG. 3.
FIG. 7 is a view in section taken along the line VII—VII in FIG. 3.

The shaft bore 9 of the magnet-yoke assembly 7 and the rotary shaft 3 are provided, where the shaft 3 is fitted in the bore 9, with shaft drive connecting means 10 comprising a bored portion 9*a* and a shaft portion 3*a* fitting therein, and with a plurality of shaft fixing means aligned with each other and with the shaft drive connecting means 10 axially of the rotary shaft and the assembly and each comprising a bored portion and a shaft portion tightly fitting in the bored portion. The bored portion 9*a* and the shaft portion 3*a* have a cross sectional form other than a circular form, for example, a form obtained by cutting off opposite sides of a circle straight (see FIGS. 5 and 7). The shaft fixing means in the front is first shaft fixing means 11, and the one in the rear is second shaft fixing means 12, the rear means 12 being diametrically larger than the front means 11. The bored portion of the means 11 and the shaft portion thereof tightly fitted therein are indicated at 9*b* and 3*b*, respectively. The bored portion and the shaft portion of the means 12 are indicated at 9*b*′ and 3*b*′, respectively. Preferably, the first and second shaft fixing means 11 and 12 are disposed in front and rear of the shaft drive connecting means 10, respectively. This arrangement serves to center the rotary shaft 3 in the magnet-yoke assembly 7 effectively when the shaft 3 is to be fitted in the shaft bore 9 and connected to the assembly 7 by the procedure to be described below. However, the means 11 and 12 may be arranged in the rear of the means 10, or the means 11 and 12 may be disposed in front of the means 10. The means 11 and 12 are of course diametrically in the above-mentioned relation in either of these modified arrangements. In the former arrangement, the diameter of the means 11 is larger than the major diameter of the means 10, while in the latter arrangement, the major diameter of the means 10 is larger than the diameter of the means 12.

Where the shaft 3 is fitted in the bore 9, the second shaft fixing means 12 includes stepped stopper means 13 which comprises an abutting portion 13′ on the shaft 3 and a stopper portion 13″ at the bored portion 9*b*′ against which the abutting portion 13′ bears. The stopper means 13 holds the shaft portion 3*b*′ to the bored portion 9*b*′ against axial displacement.

The magnet-yoke assembly 7 having the corrosion resistant layer 8 can be fixed to the rotary shaft 3 by the means 10 for driving connection and by the means 11, 12 for tight-fit connection, by forcing the rotary shaft 3 from the rear side of the assembly 7 into the shaft bore 9 defined by the covering layer 8 until the abutting portion 13′ on the shaft 3 comes into contact with the stopper portion 13″ at the corresponding bored portion 9*b*′.

Indicated at 14 is thrust bearing means for supporting the forward thrust load of the magnet-yoke assembly 7. Suitable as the thrust bearing means 14 is, for example, a flange having a sleeve 15 which is attached to a stationary portion of the pump. A ring 16 fixed to the corrosion resistant covering layer 8 of the assembly 7 is opposed to the flanged thrust bearing means 14 in contact therewith.

The pump has an impeller 17 which is drivingly connected to the front end of the rotaty shaft 3 in the same manner as the connection between the shaft portion 3*a* and the bored portion 9*a*. Indicated at 18 is a corrosion resistant synthetic resin layer covering the pump casing. The impeller chamber 20 of the pump has a rear wall 19 made of corrosion resistant synthetic resin.

I claim:

1. A corrosion resistant pump comprising a drive magnet rotatable by a motor, a driven magnet rotatable by the rotation of the drive magnet, an annular yoke having the driven magnet attached to its outer peripheral surface, a covering layer of corrosion resistant synthetic resin formed over the driven magnet-yoke assembly and defining a shaft bore in the center of the assembly, and a pump rotary shaft extending through the shaft bore of the assembly and fittingly connected to the assembly, the rotary shaft having an impeller at its front end, the pump being characterized in that the shaft bore defined by the corrosion resistant covering layer of the driven magnet-yoke assembly and the rotary shaft are provided, where the shaft is fitted in the bore; with shaft drive connecting means comprising a bored portion and a shaft portion fitting therein, the bored and shaft portions having a cross sectional form other than a circular form, and a plurality of shaft fixing means aligned with each other and with the shaft drive connecting means axially of the rotary shaft and each comprising a bored portion and a shaft portion tightly fitting in the bored portion, the shaft fixing means in the rear being diametrically larger than the shaft fixing means in the front, the diametrically larger shaft fixing means including stepped stopper means for holding the shaft portion thereof to the bored portion thereof against axial displacement.

2. A corrosion resistant pump as defined in claim 1 wherein the shaft fixing means comprises first shaft fixing means and second shaft fixing means positioned in the rear of the first shaft fixing means.

3. A corrosion resistant pump as defined in claim 2 wherein the first shaft fixing means is disposed in front of the shaft drive connecting means immediately adjacent thereto, and the second shaft fixing means is disposed in the rear of the shaft drive connecting means immediately adjacent thereto.

* * * * *